United States Patent [19]

Dupler

[11] 4,096,729

[45] Jun. 27, 1978

[54] SHEET METAL DRAW DIE APPARATUS

[75] Inventor: William W. Dupler, Birmingham, Mich.

[73] Assignee: General Motors Corporation, Detroit, Mich.

[21] Appl. No.: 801,775

[22] Filed: May 31, 1977

[51] Int. Cl.[2] ..... B21D 22/02

[52] U.S. Cl. ..... 72/350

[58] Field of Search ..... 72/360, 343, 352, 296, 72/300, 293, 412, 457, 348, 350, 351

[56] References Cited

U.S. PATENT DOCUMENTS 1,826,559 10/1931 Meier ..... 72/350 X 1,881,517 10/1932 Groehn ..... 72/350

2,067,459 1/1937 Nall et al. ..... 72/350 X

*Primary Examiner*—Milton S. Mehr

*Attorney, Agent, or Firm*—John P. Moran

[57] ABSTRACT

The sheet metal draw die apparatus disclosed is used with a double-acting press for drawing a planar metal sheet to a predetermined nonplanar drawn article. Both the lower and upper dies consist of spaced-apart modules having only male work contact surfaces formed thereon such that the juxtaposition of the upwardly and downwardly facing male work contact surfaces constitute a distinct, continuous surface defining the drawn article.

4 Claims, 3 Drawing Figures

SHEET METAL DRAW DIE APPARATUS

This invention relates generally to dies and, more particularly, to sheet metal draw die apparatus.

In the die construction field it is customary to first make a wooden die model or master model conforming to the outer surface of the article to be drawn and, hence, conforming to the surface of the punch or upper male die half required. This is generally supplemented by the addition of clay or wood around the outer periphery thereof, providing means for forming trim and binder surfaces around the drawn article. A sturdier, more durable plaster female half is then formed from the master model, followed by the formation of a plaster male half from the plaster female half.

In the meantime, metal castings are poured in the conventional manner, including a predetermined layer of stock on all surfaces. Thereafter, the plaster halves are mounted, in turn, on a duplicating or so-called "kellering" machine, along with the respective metal castings. The surface of each of the plaster models is traced in repeated spaced longitudinal strokes by a tracer element of the duplicating machine causing a cooperating cutting tool to machine the castings to the proximity of their final shapes. The machined metal castings are next subjected individually to a "spotting" or surfacing operation to smooth off the strips resulting from the longitudinal cutting strokes, and this must be done over the entire area of both of the male and female die surfaces involved. At this point, both of the smoothed castings are placed on a "try out" press for a very time consuming final spotting operation to attain matching male and female surfaces. Where needed, "bluing" is applied to one of the surfaces to pinpoint high spots as the upper and lower die halves are repeatedly brought together to obtain, by trial and error, the precise mating surfaces required over the entire surfaces of both die halves. Finally, an additional layer of metal, comparable to the thickness of the metal of the finished drawn article, is removed from selected surfaces of one of the dies by further spotting operations, while drawing planar metal blanks into nonplanar drawn articles until uniform thickness is obtained for the latter.

Inasmuch as a very substanial number of hours is involved in kellering and surfacing or spotting the entire surfaces of each of the upper and lower mating die halves to attain a substantially perfect match over their entire surfaces, it is highly desirable from a cost and time standpoint to be able to produce die halves which do not require the aforementioned extension operations.

Accordingly, a general object of the invention is to provide an improved sheet metal draw die apparatus which may be economically and quickly constructed in that only minimal kellering and surfacing operations are required, with the resultant die halves being comparable in efficiency to the above-described conventional die halves in the production of finished drawn articles.

Another object of the invention is to provide a sheet metal draw die apparatus wherein only male shapes are formed on each of the upper and lower die halves, with cavities remaining in between, directly opposite the respective male shapes formed on the opposing die half.

A further object of the invention is to provide a sheet metal draw die apparatus wherein modules are inserted in each die half, with each module bearing the shape of a particular male surface, leaving cavities therebetween directly opposite each male-shaped module in the opposing die half.

Still another object of the invention is to provide a sheet metal draw die apparatus for use with a die press for drawing a planar metal sheet to a predetermined nonplanar drawn article, and including a lower die secured to a stationary base portion of the press and consisting of a first plurality or set of modules laterally spaced in a first predetermined pattern and having upwardly facing male work contact surfaces formed thereon, and an upper die secured to a vertically movable portion of the press and consisting of a second plurality or set of modules laterally spaced in a second predetermined pattern and having downwardly facing male work contact surfaces formed thereon directly opposite the spaces separating the first plurality of modules, the juxtaposition of the upwardly and downwardly facing male work contact surfaces constituting a distinct, continuous surface defining the drawn article.

These and other objects and advantages will be apparent when reference is made on the following description and accompanying drawings wherein.

Figure 1:
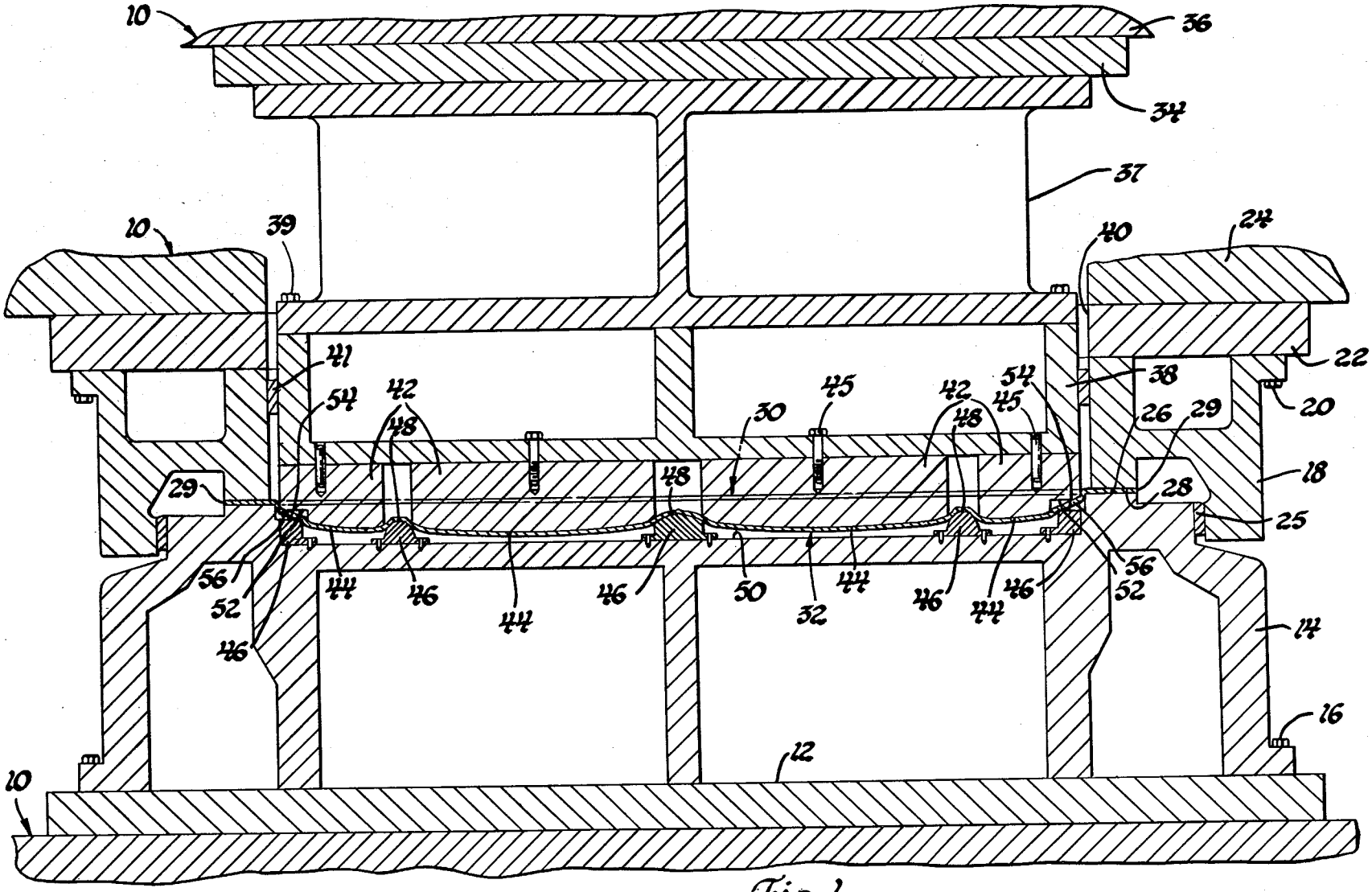
FIG. 1 is a fragmentary schematic representation of a portion of a press embodying the inventive die apparatus.

Referring now to the drawings in greater detail, FIG. 1 illustrates a double-acting press, represented at 10, including a base or bolster plate 12 having a lower shoe casting 14 secured thereon by any suitable means, such as bolts 16. An upper shoe casting 18 is secured in any suitable manner, as by bolts 20, to the bottom surface of a blank holder plate 22. The blank holder plate is mounted on a first vertically movable portion 24 of the double-acting press 10. A wear plate 25 is mounted around the outer periphery of the lower shoe 14 for receiving the descending upper shoe 18 and aligning same with the lower shoe.

Oppositely disposed blank-holder or "binder" surfaces 26 and 28 are machined adjacent the inner peripheries of the respective lower and upper shoe castings 14 and 18 for pinching and retaining therebetween the outer peripheral edge 29 of a planar sheet metal blank, represented at 30, while the central portion thereof is being drawn into a finished nonplanar drawn article, represented at 32, in a manner to be explained.

A top plate 34 is mounted on a second vertically movable portion 36 of the double-acting press 10, supporting a punch riser 37. A casting 38, which is formed to a peripheral shape generally comparable to the peripheral shape of the article 32 to be drawn, is secured in any suitable manner, such as by bolts 39 to the bottom surface of the punch riser 37 and adapted to extend through an opening 40 formed in the blank holder plate 22 to substantially the same shape as the peripheral shape of the casting 38. A second wear plate 41 is mounted around the inner periphery of the upper shoe casting 18 for receiving the descending casting 38 and aligning same with the upper and lower shoes.

Figure 2:
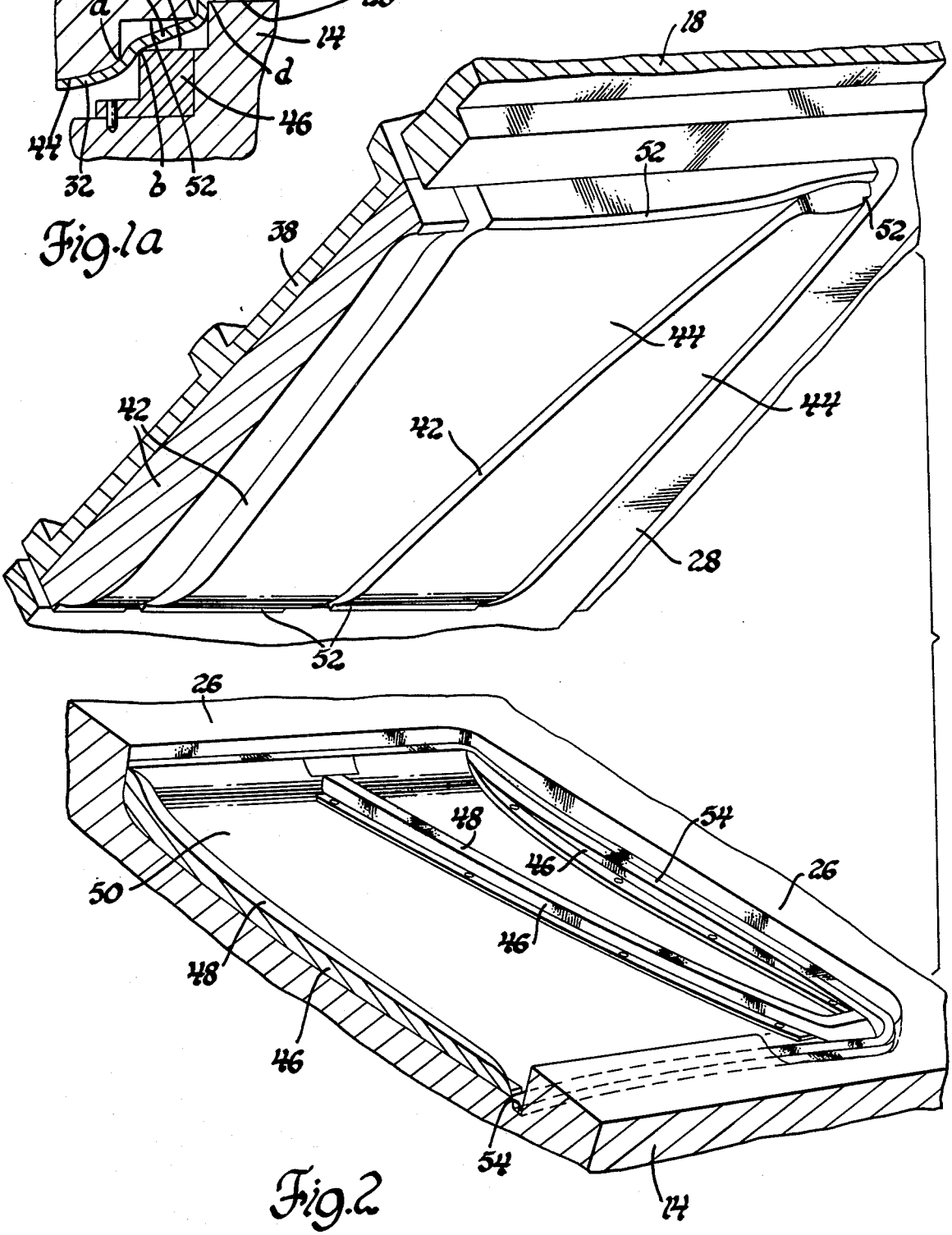
FIG. 2 is a fragmentary exploded view of portions of the upper and lower die apparatus embodying the invention.

Depending upon the particular article 32 to be drawn, a first plurality or set of modules 42 having downwardly directed male-shaped work contact surfaces 44 (FIG. 2) formed thereon are dowelled, keyed, and secured in spaced locations on the bottom surface of the casting 38 in accordance with standard die practice, represented in FIG. 1 by bolts and dowels 45.

A second plurality or set of modules 46 having upwardly directed male-shaped work contact surfaces 48 (FIG. 2) formed thereon are mounted in predetermined spaced locations in a cavity or recess 50 formed in the lower shoe 14, coordinated with the upper modules 42 such that the juxtaposition of the upwardly and downwardly facing male contact surfaces 44 and 48 form a distinct, continuous surface defining the article 32 to be drawn. The modules 42 and 46 located adjacent the walls of the recess 50 include oppositely disposed, substantially parallel surfaces 52 and 54, respectively, in order to provide a typical "trim land" portion 56 around the edge of the drawn article 32 suitable for final trimming. The surfaces 52 and 54 are spaced apart an amount sufficient to assure that there is no interference with the pinching action of the blank-holder surfaces 26 and 28 on the sheet metal blank 30. The spacing is such that the trim land is typically retained within a range of from 0°to 15°with respect to horizontal. As may be noted in FIG. 2, the trim land-forming surfaces 52 and 54 are formed around the entire outer periphery of the die halves at various levels, depending upon the edge shapes of the finally drawn article 32, while the blank-holder surfaces 26 and 28 may remain at a constant level around the entire periphery or may vary in shape in those applications where large contours are present in the drawn article. For simpler shaped drawn articles, the binder surfaces 26 and 28 may serve as partial or total trim land forming surfaces.

It is important to note that the modules 42 and 46 can be cast, machined, and surfaced individually, and without having to match any oppositely disposed nonplanar mating surfaces, thereby eliminating a substantial amount of tedious and very time consuming die finishing operations.

Figure 1A:
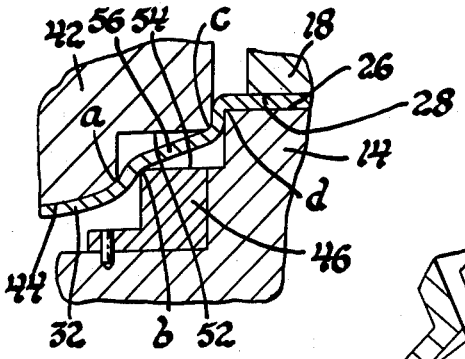
FIG. 1*a* is an enlarged fragmentary cross-sectional view of a portion of FIG. 1.

In operation, the upper shoe 18 is lowered around the wear plate 25 on the lower shoe 14, clamping the peripheral edge portion 36 onto the sheet metal blank 30, represented in phantom in FIG. 1, and forced downwardly, thereby serving to first draw the blank 30 around the contact surfaces 44, and then around the opposing contact surfaces 48, whereupon the upper and lower modules become juxtapositioned or intermeshed as shown in FIG. 1, to the extent that the article 32 is drawn to conform to the respective male-shaped work contact surfaces 44 and 48 of each of the respective upper and lower modules 42 and 46. It should be noted that the trim land portion 56 is formed by four forming areas *a, b, c, d* formed on the surfaces 44, 54, 52, and 26, respectively, as shown in FIG. 1*a*. For some peripheral sections, the locations of the forming areas *a, b, c, d* may vary, e.g., the surface 52 may include both *b* and *c*, as would be the case at the forward portion of FIG. 2.

Tests have shown that the planar sheet metal blank 30 readily conforms to the shapes of the respective downwardly and upwardly oriented male contact surfaces, and that there is no need to have any contacting surface located opposite any other contacting surface, as has heretofore been the practice, in order to produce substantially perfectly formed drawn articles.

Once the drawn article 32 is formed to the shape shown in FIG. 1, the punch riser 37 and its associated modules 42, and the upper shoe 18, are raised and the drawn article removed from the lower shoe 14, whereupon the outer flange or peripheral edge 29 thereof, which had been confined between the blank-holders or binders 26 and 28 as indicated above, and a portion of the trim land 56, which had been formed between the overlapped and spaced surfaces 52 and 54, as explained above, are cut away from the drawn article 32 such that a predetermined narrow flanged surface remains around the peripheral edge of the drawn article 32 suitable for being folded-under to eliminate any external sharp edges around the finished article.

It should be apparent that the inventive modular approach to draw die construction provides a simplified, economical, and efficient draw die apparatus.

It should be further apparent that the inventive juxtapositioned or intermeshed upwardly and downwardly oriented male modules may be individually shaped as required to draw virtually any nonplanar finished article from a planar metal sheet.

It should also be apparent that in this arrangement modules which may become worn may be individually replaced, as compared to replacing an entire die half.

What is claimed is:

1. A sheet metal draw die apparatus for use with a die press for drawing a planar metal sheet to a predetermined nonplanar drawn article in a single operation, said die apparatus comprising an upper die secured to a vertically movable portion of the die press and including a first plurality of modules laterally spaced in a first predetermined pattern to provide a first plurality of cavities therebetween and having downwardly facing work contact surfaces formed thereon, and a lower die secured to a stationary base portion of the die press and including a second plurality of modules laterally spaced in a second predetermined pattern to provide a second plurality of cavities therebetween and having upwardly facing work contact surfaces formed thereon directly opposite the first plurality of cavities, the juxtaposition of said upwardly and downwardly facing work contact surfaces constituting a distinct, continuous surface defining the drawn article, with the surfaces of said planar metal sheet on the respective sides thereof adjacent said first and second pluralities of cavities being spaced apart from the bottoms of the cavities upon completion of the vertical movement of the upper die.

2. A sheet metal draw die apparatus for use with a die press for drawing a planar metal sheet to a predetermined nonplanar drawn article in a single operation, said die apparatus comprising an upper die secured to a vertically movable portion of the die press and including a first plurality of modules laterally spaced in a first predetermined pattern to provide a first plurality of cavities therebetween and having downwardly facing male-shaped surfaces formed thereon for contacting predetermined areas of the planar metal sheet, and a lower die secured to a stationary base portion of the die press and including a second plurality of modules laterally spaced in a second predetermined pattern to provide a second plurality of cavities therebetween any having upwardly facing male-shaped surfaces formed thereon directly opposite the cavities separating the first plurality of modules for contacting the remaining areas of the metal sheet on the opposite side thereof after a predetermined downward movement of the upper die, the juxtaposition of said upwardly and downwardly facing male-shaped surfaces constituting a distinct, continuous surface defining the drawn article, with the surfaces of said planar metal sheet on the respective sides thereof adjacent said first and second pluralities of cavities being spaced apart from the bottoms of the cavities upon completion of the vertical movement of the upper die.

3. A sheet metal draw die apparatus for use with a double-acting press for drawing a planar metal sheet to a predetermined nonplanar drawn article in a single operation, said die apparatus comprising downwardly facing blank-holder means secured to a first vertically movable portion of the double-acting press, an upper die secured to a second vertically movable portion of the double-acting press and including a first plurality of modules laterally spaced in a first predetermined pattern to provide a first plurality of cavities therebetween and having downwardly facing male-shaped work contact surfaces formed thereon, and a lower die secured to a stationary base portion of the double-acting press and including upwardly facing blank-holder means formed directly opposite the downwardly facing blank-holder means and a second plurality of modules laterally spaced in a second predetermined pattern to provide a second plurality of cavities therebetween and having upwardly facing work contact surfaces formed thereon directly opposite the cavities separating the first plurality of modules, the downwardly facing blank-holder means serving to confine the peripheral edge portion of the planar metal sheet against the upwardly facing blank-holder means prior to the downwardly facing male-shaped work contact surfaces contacting the planar metal sheet, the upwardly and downwardly facing work contact surfaces constituting a distinct, continuous surface defining the drawn article with the surfaces of said planar metal sheet on the respective sides thereof adjacent said first and second pluralities of cavities remaining spaced apart from the bottoms of the cavities once the downwardly facing male-shaped work contact surfaces have completed their downward movement to attain a juxtapositional relationship with the upwardly facing male-shaped work contact surfaces.

4. A modular sheet metal draw die apparatus for use with a double acting die press for drawing a planar metal sheet to a predetermined nonplanar drawn article in a single operation, said die apparatus comprising a lower shoe secured to a lower stationary base portion of said die press, an upper shoe secured to a first vertically movable portion of said die press, said upper shoe having a central opening of a predetermined shape formed therethrough, oppositely disposed binder surfaces formed on said upper and lower shoes for holding the edge portion of said planar metal sheet once said shoe is lowered into contact therewith, a punch riser secured to a second vertically movable portion of said die press, said punch riser adapted to being reciprocably moved through said central opening after said binder surface on said upper shoe has contacted said planar metal sheet, a casting secured to said punch riser, a first plurality of laterally spaced modules secured to said casting to provide a first plurality of cavities therebetween and having downwardly facing work contact surfaces formed thereon, a recess formed in said lower shoe and having a peripheral shape the same as the shape of the central opening, a second plurality of spaced modules secured to the bottom of said recess to provide a second plurality of cavities therebetween and having upwardly facing work contact surfaces positioned directly opposite the cavities between said first plurality of modules, said first and second pluralities of modules acting as dies for drawing respective opposite sides of metal sheet without contacting the portions of the surfaces thereof adjacent said cavities during downward movement of said second vertically movable portion of said die press, thereby forming the nonplanar drawn article, and oppositely disposed peripheral trim land surfaces formed on the end portions of each of said first and second pluralities of modules and on the peripheral edge portions of each of said casting and said recess intermediate the respective end portions of said first and second pluralities of modules for confining a peripheral area portion of said metal sheet therebetween for final trimming after said drawn article is formed and removed from the die press.

* * * * *

UNITED STATES PATENT AND TRADEMARK OFFICE

CERTIFICATE OF CORRECTION

PATENT NO. : 4,096,729

DATED : June 27, 1978

INVENTOR(S) : William W. Dupler

It is certified that error appears in the above-identified patent and that said Letters Patent are hereby corrected as shown below:

Column 3, line 58, "located opposite" should read -- located directly opposite --.

Column 4, line 55, "therebetween any" should read -- therebetween and --.

Column 6, line 7, "said shoe" should read -- said upper shoe --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*